United States Patent [19]

Roberts

[11] Patent Number: 4,833,956

[45] Date of Patent: May 30, 1989

[54] VERTICALLY SPACED CARPET CUTTER FOR CUTTING OVERLAPPED CARPET SECTIONS TO BE ABUTTED

[75] Inventor: Kenneth B. Roberts, Kenner, La.

[73] Assignee: Double Cut, Inc., New Orleans, La.

[21] Appl. No.: 25,491

[22] Filed: Mar. 13, 1987

[51] Int. Cl.[4] ..... B26B 25/00

[52] U.S. Cl. ..... 83/56; 30/287; 30/294

[58] Field of Search ..... 30/287, 294; 83/13, 83/52, 56

[56] References Cited

U.S. PATENT DOCUMENTS

| | | | |
|---|---|---|---|
| 3,363,314 | 1/1968 | O'Brien | 30/125 |
| 3,621,573 | 11/1971 | Summers | 30/287 |
| 3,934,341 | 1/1976 | Carlson | 30/287 |
| 4,064,627 | 12/1977 | Zanfini | 30/287 |
| 4,095,341 | 6/1978 | Crain | 30/287 |

OTHER PUBLICATIONS

"Roberts Floor Covering Products", p. 23, date unknown.

"Crain Floor Covering Tools", p. 8, Jan. 1984, catalog No. 116C.

*Primary Examiner*—Frank T. Yost
*Assistant Examiner*—Hien H. Phan
*Attorney, Agent, or Firm*—C. Emmett Pugh

[57] ABSTRACT

A carpet cutter for concurrently cutting a pair of overlapping carpet portions lying on a floor, comprising a body, flat longitudinally extending base plate extending downward from the body and adapted to be drawn across the floor, and a handle extending upwardly from the plate for drawing the plate across the floor. Upper, lower and intermediate, elongated guides are spaced vertically below the handle and above the undersurface of the base plate forming a pair of vertically spaced, one-above-the-other, parallel, upper and lower, horizontally extending, longitudinal slots between the guides. A pair of overlapping carpet portions are respectively positioned in the slots. The carpet portions have a sliding engagement with the guides for maintaining alignment of the overlapped carpet portions suitable for making simultaneous, parallel, one-above-the-other, abutting cuts with the same stroke to concurrently sever the carpet backings of the overlapping carpet portions, so that the severed edges can be joined to provide an invisible seam. A blade attached to the body of the cutter in a configuration adjacent the guides has its cutting edge intersecting with each horizontally extending, longitudinal slot for severing the carpet backings, as the base plate is drawn across the floor. A pair of oppositely diverging blades (FIG. 1) can be included for either right hand or left hand usage, and the tool can be powered with a driven circular cutting blade (FIGS. 5–7).

20 Claims, 4 Drawing Sheets

VERTICALLY SPACED CARPET CUTTER FOR CUTTING OVERLAPPED CARPET SECTIONS TO BE ABUTTED

BACKGROUND OF INVENTION

1. Field of Invention

This invention relates generally to a hand tool, and more particularly is directed towards a hand tool for cutting overlapping carpets, pads and the like simultaneously in the same stroke, so that two, one-above-the-other, parallel cuts in the overlapped carpet portions are simultaneously made, the carpet backings thereby being identically severed in mirror fashion, available for abutting joining to provide an invisible seam.

2. Prior Art & General Background

The installation of carpeting on the floors of homes, office buildings, theatres and the like usually requires a considerable amount of trimming or cutting. In the case of wall-to-wall carpeting, for example, the outer edges of the carpeting must be carefully trimmed to conform to the shape of the floor that is being covered; and confronting edges of adjacent widths of the carpeting must be carefully matched to avoid unsightly seams.

Furthermore, in the case of pile carpets, wherein successive rows of piles extend parallel to one another, it is usually desireable to cut or trim the carpet along a straight line between adjacent rows of pile.

In the past it has been customary to trim pile carpeting with a hand tool or cutter containing a razor blade, which projects from the bottom of the tool just far enough to penetrate through the carpet backing, when the tool is drawn longitudinally along the space between adjacent rows of pile. Some such tools have also included a projecting rib or guide to help guide the cutter longitudinally between adjacent rows of pile. Commercial examples of some such cutters are available from Crain Cutter Co., Inc., (Milpitas, CA) and Roberts Consolidated Industries, (City of Industry, CA).

For other examples of carpet cutters note the following patents.

U.S. Pat. No. 4,064,627, issued to Zanfini on Dec. 27, 1977, is directed to a carpet cutter which is particularly arranged for use with a carpet tacking strip, having a flange about which the carpet secured to it is wrapped, so as to provide a finished edge for the carpeting, without the use of molding, etc., at the edge.

The cutter of U.S. Pat. No. 3,363,314 to G. S. O'Brien issued on Jan. 16, 1968, includes a vertically arranged guide member and angled cutting blades having edges which face outwardly in opposite directions lying adjacent the vertically arranged guide member. The blades are used for trimming an upwardly turned edge of the carpeting, which is anchored to a tack strip, as the cutter is pushed. The cutter of U.S. Pat. No. 3,934,341 to Carlson issued on Jan. 27, 1976, may be used to trim an even strip of carpet around the boundary of a pad or prelaid carpet prior to the installation of new wall-to-wall carpeting.

Another problem, which is encountered when two sections of carpet must be installed adjacent one another, concerns the difficulty in cutting two perfectly straight, parallel edges on the two different sections, so that the severed, abutting edges can be joined to provide an invisible seam. This is the particular problem to which the present invention is directed.

With present carpet cutters, it has been necessary to make a separate cut in each section of carpet. Unless extreme care is taken with each cut, the severed edges will not abuttingly match satisfactorily.

A concurrent, double-cut cutter is disclosed by J. A. Summers in U. S. Pat. No. 3,621,573 issued on Nov. 23, 1971 (note FIGS. 5 & 6). The Summers cutter has a pair of cutter blades which are laterally spaced and located along the same horizontal plane, so that the blades make simultaneous, spaced, parallel cuts in adjacent sections of carpet. The concurrent, spaced cuts on the sections produce identical edges, which are thereafter placed together to form an almost invisible seam.

However, the severed portion of one of the cut carpet sections ends up under the adjacent carpet section, requiring it to thereafter be removed, in contrast with the present invention in which the severed parts of both carpet portions fall unto the top, exposed side of the adjacent carpet portion, respectively. Thus, the structure of the Summers cutter does not allow the carpet sections to be cut in an overlapping configuration, with for example the vertically spaced, one-above-the-other cutters located in different horizontal planes of the present invention.

Additionally, the Summers cutter requires the post-cutting movement of at least one of the carpet sections with respect to the other the distance of the laterally spaced cutter blades, in order to place the edges in abutment to form the invisible seam.

These added steps require an additional, significant expenditure of time and, in the case of heavy carpets, additional, substantial physical labor. Further, the Summers cutter does not allow the sections to be abutted while the cut is being made, allowing a chance for one of the carpet portions to shift and cause unidentical cuts to be made in the sections.

Additionally, the Summers tool, due to the lateral rather than vertical spacing of the cutter blades, produces a relatively bulky device.

The Summers cutter has been available to the art for a long period of time, and a commercial embodiment thereof, it is believed, has been unsuccessful and at least generally not used. For example the Roberts Model 10-909 "adjustable double cutter" (Roberts Consolidated Industries, City of Industry, CA) has been commercially unaccepted at least in the New Orleans, LA market area.

One object of this invention, therefore, is to provide an improved carpet cutter, which will cause a pair of overlapping carpet portions to be cut simultaneously with vertically spaced cutter blades and guides with the same cutting stroke for allowing parallel abutting cuts to be made, so that the severed edges on the carpet portions can be abutted exactly to form an almost invisible seam without the subsequent need for removing cut portions from under adjacent carpet sections or the need to substantially move laterally the cut carpet sections.

Another object of the present invention is to provide an improved carpet cutter which is compact and easily used, with a minimum of effort and labor.

SUMMARY DISCUSSION OF THE INVENTION

In accordance with these objects, the cutting according to the method and apparatus of the present invention features upper, intermediate and lower horizontally extending, vertically spaced guide means for forming a pair of vertically spaced, parallel, upper and lower, horizontally extending, one-above-the-other, longitudinal, cutter slots between the guide means, in which a pair of upper and lower overlapping carpet portions may be positioned, with a lower carpet portion positioned between the lower and intermediate guide means and the upper overlapping carpet portion positioned between the intermediate and the upper guide means. With the carpet portions so positioned, the lower carpet portion is allowed to have a sliding engagement between the lower guide means and the intermediate guide means, and the overlapping carpet portion is allowed to have a sliding engagement between the intermediate and upper guide means for maintaining alignment of the overlapped carpet portions suitable for making simultaneous, parallel, immediately adjacent, abutting cuts to sever the carpet backing of the overlapping carpet portions, as the carpet cutter is drawn across the floor.

A downward extending blade is located in each horizontally extending longitudinal slot for severing the carpet backings as the carpet cutter is drawn across the floor. The blade may be a pair of downward diverging blades which have their cutting edges facing outwardly in opposite directions, so that the cutter is most useful for cutting in either direction along the longitudinal axis of the cutter, making it more useful by left handed people. Preferably the back sides of the blades make an angle of about forty-five degrees or less from the horizontal.

Alternatively, the blade may be a downward extending blade which intersects angularly with each horizontally extending longitudinal slot, with its cutting edge facing into the longitudinal slots.

In a further embodiment, the cutter according to the method and apparatus of the present invention may have a powered circular blade rotatively attached to the cutter, so that its circular cutting edge intersects with each longitudinal slot. An electric motor included with the cutter for rotating the circular blade about its axis of rotation causes the cutting edge of the circular blade to move laterally in the longitudinal slots, as the cutter is moved across the floor for cutting the overlapping carpet portions. Alternatively, a powered reciprocating blade or band cutter could be used.

Consequently, the cutter according to the method and apparatus of the present invention allows parallel, one-above-the-other, immediately adjacent, abutting cuts to be made, so that the severed edges can be abutted exactly without having to thereafter substantially laterally move the cut sections and place the carpet sections in abutment to form the near invisible seam. Further the cutter allows the carpet portions to be abutted exactly as the cuts are being made to form an almost invisible seam, by for example using a riser under the body of the lower carpet portion to vertically align the severed edges, as the carpet portions are being cut, and alternatively removing the trimmed edge of the lower carpet portion as the carpet portions are being cut, allowing the severed edge to be vertically aligned during cutting.

All this is achieved with the severed carpet remnants falling unto the top, exposed sides of the carpet sections being laid, allowing for their easy removal, without risk of the severed remnant being left under one of the laid, cut carpet sections.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 2 is a side view of a second preferred, exemplary embodiment according to the method and apparatus of the present invention; while

FIG. 5 is a side view of a third preferred, exemplary embodiment ac to the method and apparatus of the present invention; while

DETAILED DESCRIPTION OF THE PREFERRED, EXEMPLARY EMBODIMENTS

Figure 1:
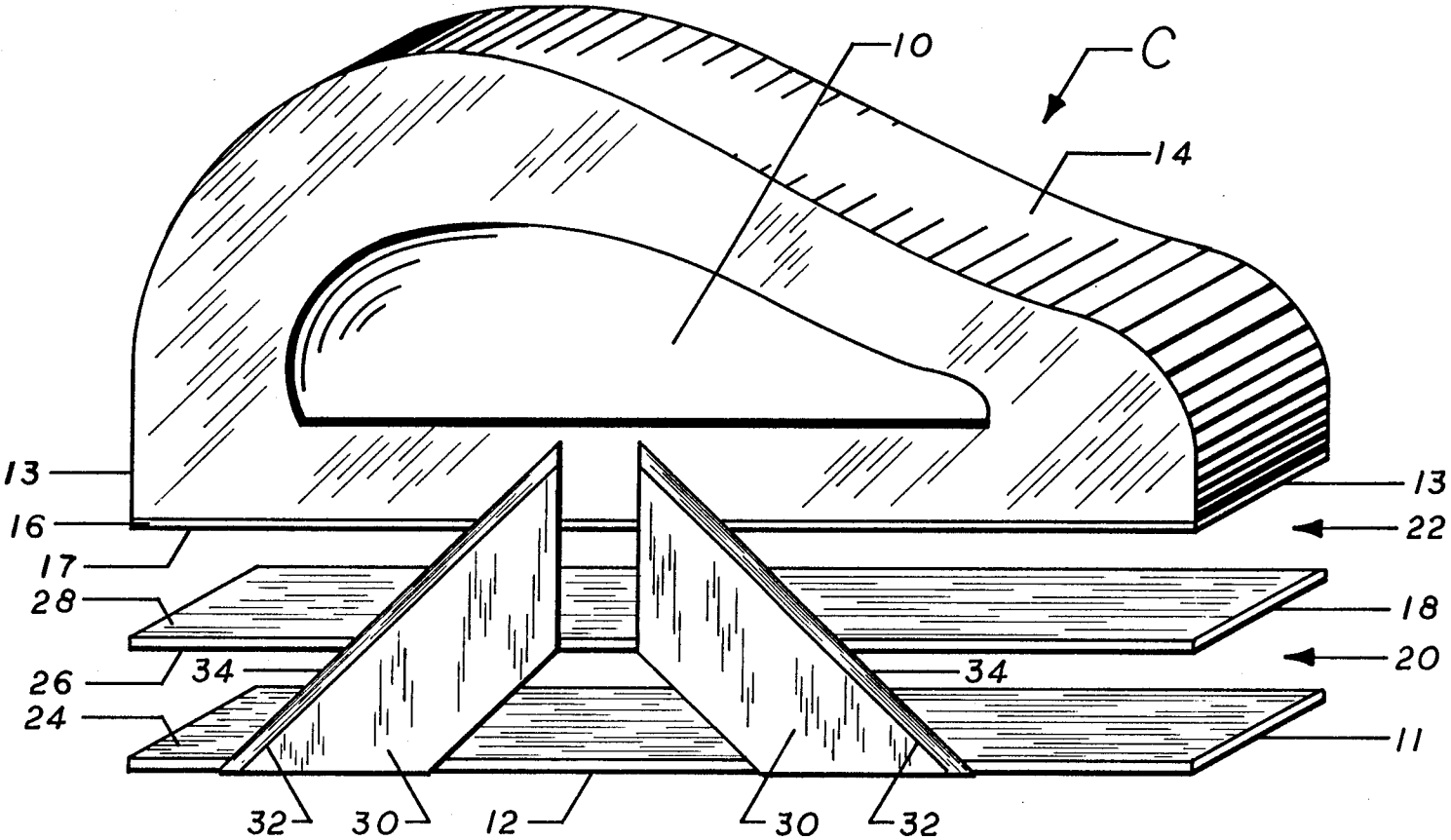
FIG. 1 is an elevated view of a first preferred, exemplary embodiment of the present invention according to the method and apparatus of the present invention.
Figure 3:
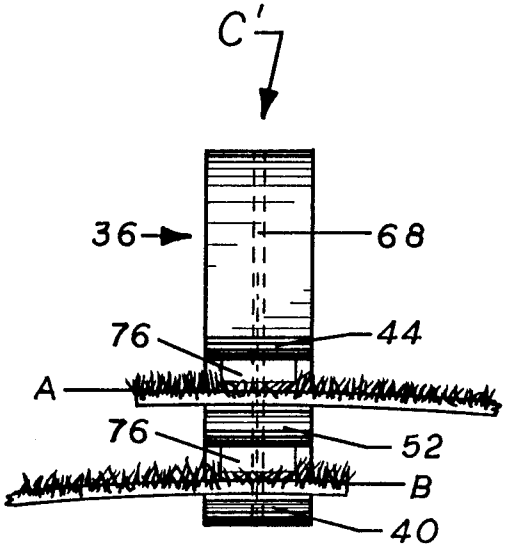
FIG. 3 is a front end view of the preferred embodiment of FIG. 2 also the two adjacent carpet sections being cut.
Figure 4:
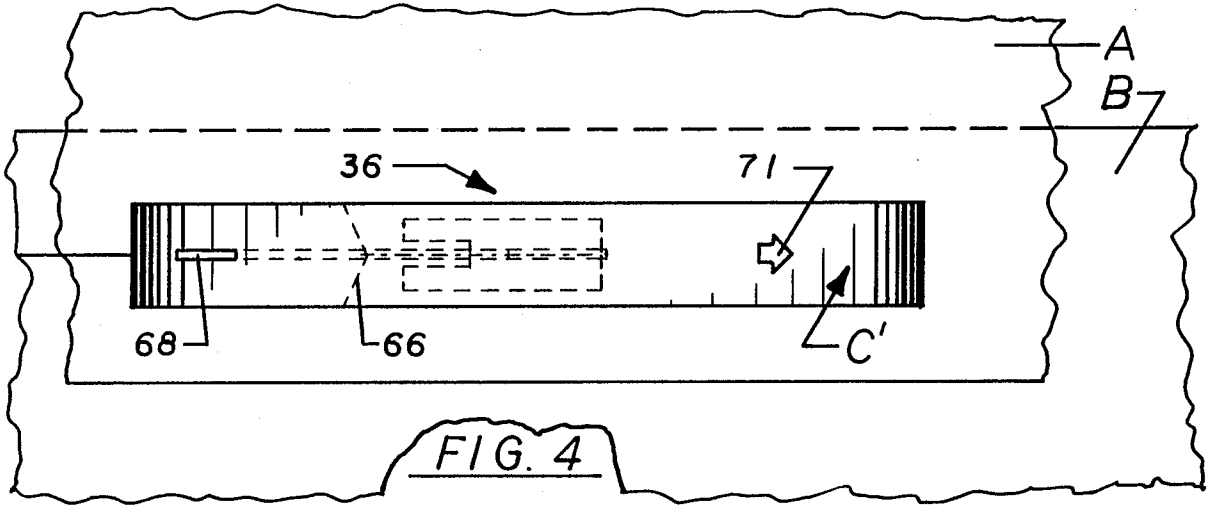
FIG. 4 view of the preferred embodiment of FIG. 2 also.

Referring to FIG. 1, a carpet cutter C according to the method and apparatus of the present invention and suitable for cutting a pair of unseen overlapping carpet portions lying on a floor is shown (although a comparable over-lapping carpet situation is shown in FIGS. 3 and 4). The cutter C includes a body 10 and a flat, longitudinally extending horizontal base plate 11. The plate 11 extends downward from body 10, which is adapted to be drawn across the floor and includes a generally rectangular, planar bottom or undersurface 12 on the bottom of the plate 11 for facilitating its motion across the floor. The base plate 11 may be any suitable material such as aluminum or carbon steel and is cut to the desired shape by any suitable means.

Intermediate of the ends 13 of the base plate 11 is an upwardly projecting, hump shaped handle 14. The handle 14 extends upwardly from body 10 by any suitable means and may be of any suitable material, such as wood or metal, and provides a handle means included with body 10 for drawing the plate 11 across the floor.

Disposed along the undersurface of body 10 is a horizontally disposed, generally rectangular plate 16 having a longitudinally extending planar bottom 17. Plate 16 is preferably of a suitable material, such as aluminum or steel or heavy duty plastic, and may be formed integral with body 10 or may be attached thereto by any suitable means such as threaded fasteners. A longitudinally extending horizontal planar plate 18 extends downward from body 10 in a vertically spaced, parallel relationship between plate 11 and plate 16.

Plate 18 may likewise be made of any suitable material, such as aluminum or steel or heavy duty plastic, and together with base plate 11 provides vertically spaced, lower and intermediate longitudinal guide means, with plate 11 providing the lower guide means and plate 18 providing the intermediate guide means. As may be appreciated, plate 16 provides an upper guide means, which together with the guide means provided by plates 11 and 18 form a pair of spaced, parallel upper and lower horizontally extending longitudinal slots 20, 22 between the guide means.

Slot 20 is disposed between plates 11 and 18 and is defined by the longitudinally extending planar upper surface 24 of plate 11 and the longitudinally extending planar lower surface 26 of plate 18. Slot 22 is disposed between plates 18 and 16 and is defined by the longitudinally extending planar upper surface 28 of plate 18 and the longitudinally extending planar lower surface 17 of plate 16.

An unseen (but see FIGS. 3 and 4) pair of upper and lower, overlapping carpet portions are positioned between the guide means provided by plates 11, 18 and 16 in a configuration having the lowermost carpet portion positioned in slot 20 between the horizontal, longitudinally extending, planar upper surface 24 of plate 11 and the horizontal, longitudinally extending, planar lower surface 26 of plate 18. The upper, overlapping carpet portion is positioned in slot 22 between the horizontal, longitudinally extending planar upper surface 28 of plate 18 and the planar bottom 17 of plate 16.

A cutting means is attached to body 10 in a downward extending configuration adjacent the guide means provided by plates 11, 18 and 16. The cutting means preferably extends downward in its configuration to intersect with each horizontally extending longitudinal slot 20 and 22 at an angle for example of about forty-five degrees or less for severing the carpet backings, as the base plate 11 is drawn across the floor. Such a downward biased alignment is desirable as it causes the cutting means to initially intersect the carpet backing and not the pile avoiding the cutting of the pile or face of the carpet.

As shown in FIG. 1, the cutting means may be a plurality of downward extending, opposite facing, diverging blades 30, which have preferably an angle at their back-sides of forty-five degrees or less to the horizontal and have their upper ends 26 attached to body 10. Accordingly, the blades 30 would have their cutting edges 32 facing outwardly in opposite directions for cutting the unseen overlapping carpet portions, as they are drawn between the guide means by the movement of the base plate 10 across the floor. Further, the blades 30 may be attached to the sides of plates 16, 18 and 11 as indicated in FIG. 1, for spacing the plates 18 and 11 one above the other below body 10 and positioning the blades 30 in their configuration adjacent to the plates 16, 18 and 11.

Further, planar surfaces 17, 24, 26 and 28 provide smooth surfaces on which the carpet portions may be slid, allowing the carpet portions to have a sliding engagement between the guide means provided by plates 11, 18, 16. This assists in allowing the cutter C to be smoothly slid for aiding in eliminating undesirable wiggling of the cutter C in a horizontal plane during cutting. As may further be appreciated, by providing a pair of blades such as blades 30 having their cutting edges 34 facing outwardly in opposite directions, the cutter C is most useful for cutting in either direction along the longitudinal axis of the cutter C and can be used by either left handed or right handed people.

Figure 2:
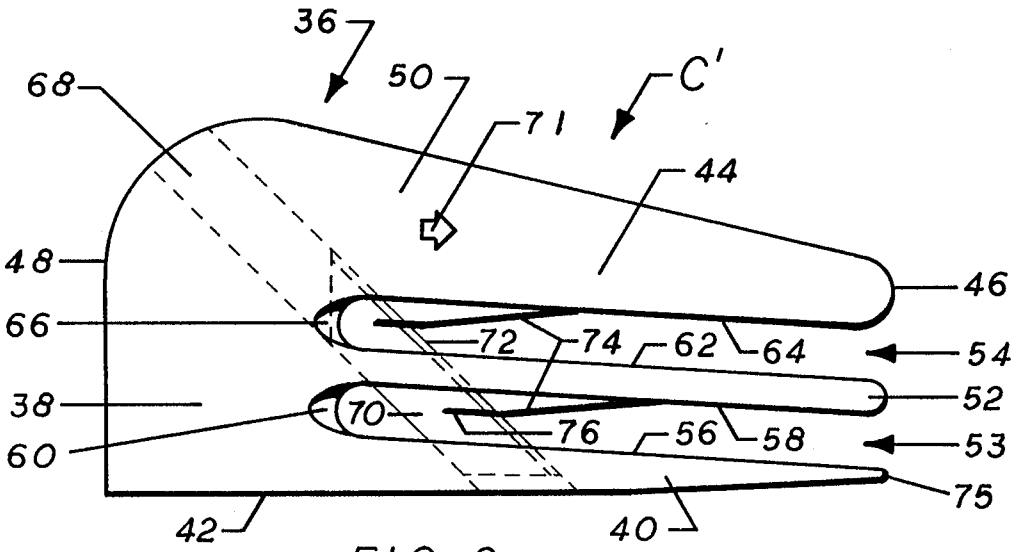

Referring to FIGS. 2, 3 and 4, a second preferred embodiment of the cutter (herein designated C') according to the present invention is seen. The cutter C' includes a body 36 similar to body 10 having a downward extending web portion 38, which as shown may be formed integral with body 36 by any suitable means such as casting. Extending laterally from the lower portion of web 38 is an elongated finger 40 similar in function to plate 11. Extending across the bottom of web 38 and finger 40 is an elongated planar bottom or undersurface 42 similar to undersurface 12, which is adapted to be drawn across the floor. A second elongated finger 44 similar in function to plate 16 extends laterally from web 38 in a spaced, opposed relationship above finger 40.

Intermediate of the ends 46 and 48 of finger 44 and web 38, respectively, is an upwardly projecting hump shaped handle 50. The handle 50 extends upwardly from body 36 by suitable means such as being formed integral with body 10 and provides a means included with body 36 for drawing the undersurface 42 of web 36 and finger 40, which functions as a base plate, across the floor.

An intermediate elongated finger 52 extends laterally from web 38 in a vertically spaced, parallel relationship between fingers 40 and 44. Hence body 36, web 38, fingers 40, 52 and 44 may be cast or cut in a preferably unitary construction in any suitable material such as aluminum for rigidity and ease of manufacture. The fingers 40, 52, 44 provide vertically spaced lower, upper and intermediate guide means, respectfully, similar to the guide means of the first embodiment.

Formed between the guide means are a pair of spaced, parallel, one-above-the-other upper and lower, horizontally extending, juxtaposed, longitudinal slots 53 and 54, which are similar to longitudinal slots 20 and 22. Slot 53 is disposed between fingers 40 and 52 and is defined by the longitudinally extending planar upper surface 56 of finger 40 which is similar to surface 24, the lower longitudinally extending planar surface 58 of finger 52 which is similar to surface 26 and a curved portion 60 of web 38 between fingers 40 and 52. Slot 54 is disposed between fingers 58 and 44 and is defined by the longitudinally extending planar upper surface 62 of finger 52 which is similar to surface 28, the lower longitudinally extending planar surface 64 of finger 44 which is similar to surface 17, and a second curved portion 66 of web 38 between fingers 52 and 44. The two slots 53, 54 are right adjacent to one another, being separated by the thickness of the finger 52 having a thickness of for example about a quarter or half an inch.

The pair of upper and lower, overlapping carpet portions or sections A and B are positioned between the guide means provided by fingers 40, 52, 44 in a configuration having the lower carpet portion positioned in slot 53 between the longitudinally extending planar upper surface 56 of finger 40 and the longitudinally extending planar lower surface 58, and the upper overlapping carpet portion positioned between the horizontal, longitudinally extending planar upper surface 62 extending along the upper surface of finger 52 and the longitudinally extending planar lower surface 64 extending along the bottom of finger 44.

Included in body 36 is a slot 68, which extends diagonally through body 36 and fingers 52, 40 to intersect with undersurface 42. Disposed within slot 68 is the cutting means in the form of an elongated blade 70, which is located in slot 68 in a downward, diagonally extending configuration adjacent to the guide means provided by fingers 40, 52, 44 and which is fixedly held therein by any suitable means, such as an unseen fastener such as a screw. The blade 70 extends downward and diagonally in its configuration to intersect with each horizontal extending longitudinal slot 53, 54 preferably at a backside angle of forty-five degrees or less for severing the carpet backing as the undersurface 42 of web 36 and finger 40, which functions as a base plate, is drawn across the floor. Hence, the curved portion 66, 60 are tapered outwardly toward their juncture with web 36, as best shown in FIG. 4, for allowing the web 38 to easily pass between the cut, abutting carpet portions as the cutter C' is drawn across the floor. Further, the blade 70 has its cutting edge 72 facing inward into slots 53, 54, so that the back-sides of the overlapping carpet portions A and B may be cut, as the cutter C' is drawn in a direction as indicated by arrow 74 across the floor.

Further, planar surfaces 56, 58, 62, 64 provide smooth surfaces on which the carpet portions may be slid, allowing the carpet portions to have a sliding engagement between the guide means provided by fingers 40, 52, 44. This assists in allowing the cutter C' to be smoothly slid for aiding and eliminating undesirable wiggling of the cutter C' in a horizontal plane during cutting. Further finger 40 may taper as shown in the figure toward its distal tip 75 and a biasing means may be included in each slot 53, 54 for retaining the carpet portions in contact with at least one of the guide means during cutting to prevent the carpet portions from becoming bunched and moving vertically within the slots during cutting.

Accordingly, upper planar surfaces 64, 58 of slots 54, 53 have an elongated, spring-like member 74 attached thereto which extends downward and rearward in slots 54, 53 to intersect with blade 70. Further blade 70 includes an unseen axial, bisecting slot at its tip 76 in which the cutting edge 72 of blade 70 is disposed so that the tip 76 of spring-like member 74 may move along a longitudinal length of blade 70 while moving laterally within slot 53, 54. Hence adjacent the cutting edge 72, spring-like portion 74 biases the overlapping carpet portions respectfully into engagement with the upper planar surfaces 56, 62 at the point of cutting to maintain ease of cutting and prevent jamming and vertical movement of the carpet portions during cutting. As may be appreciated, the cutter C' is symmetrical on both sides and may be used by either right handed or left handed people.

Figure 6:
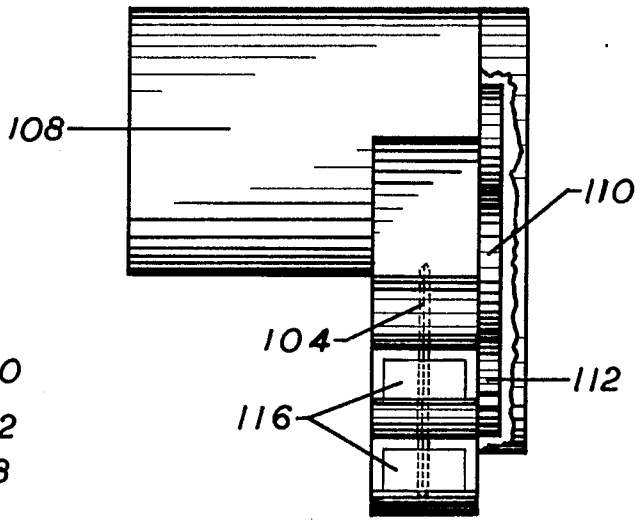
FIG. 6 is a front end view of the third preferred embodiment of FIG. 5.
Figure 7:
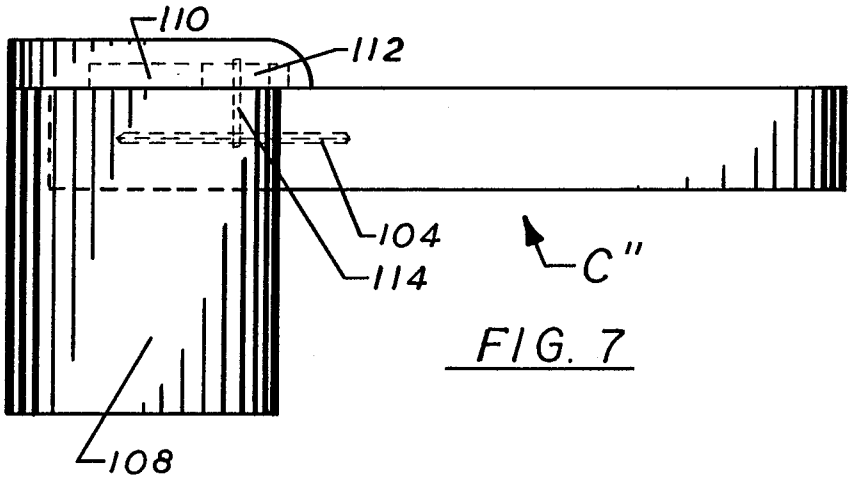
FIG. 7 is a top view of the third preferred embodiment of FIG. 5.
Figure 5:
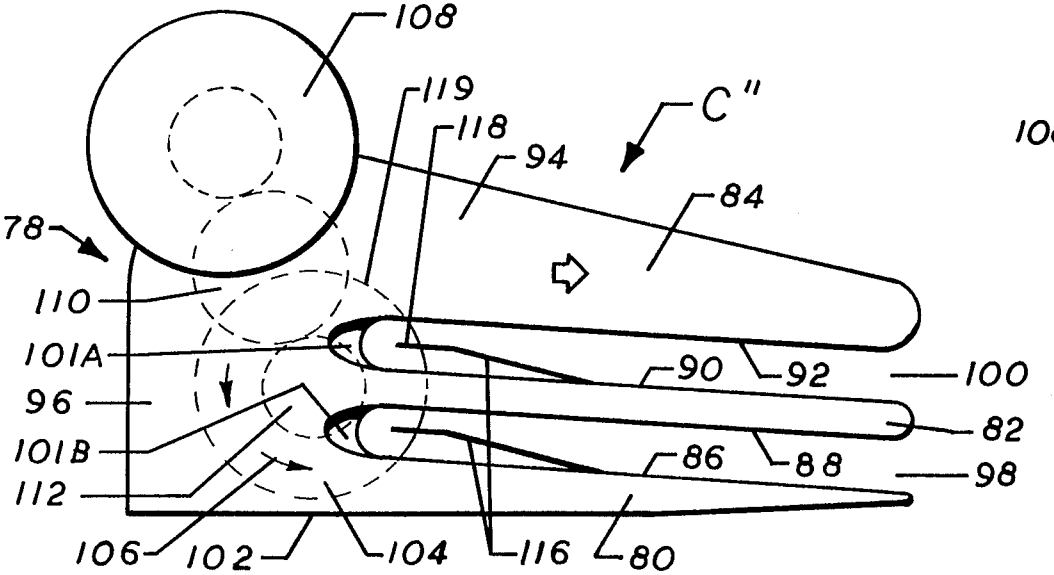
Figure 8:
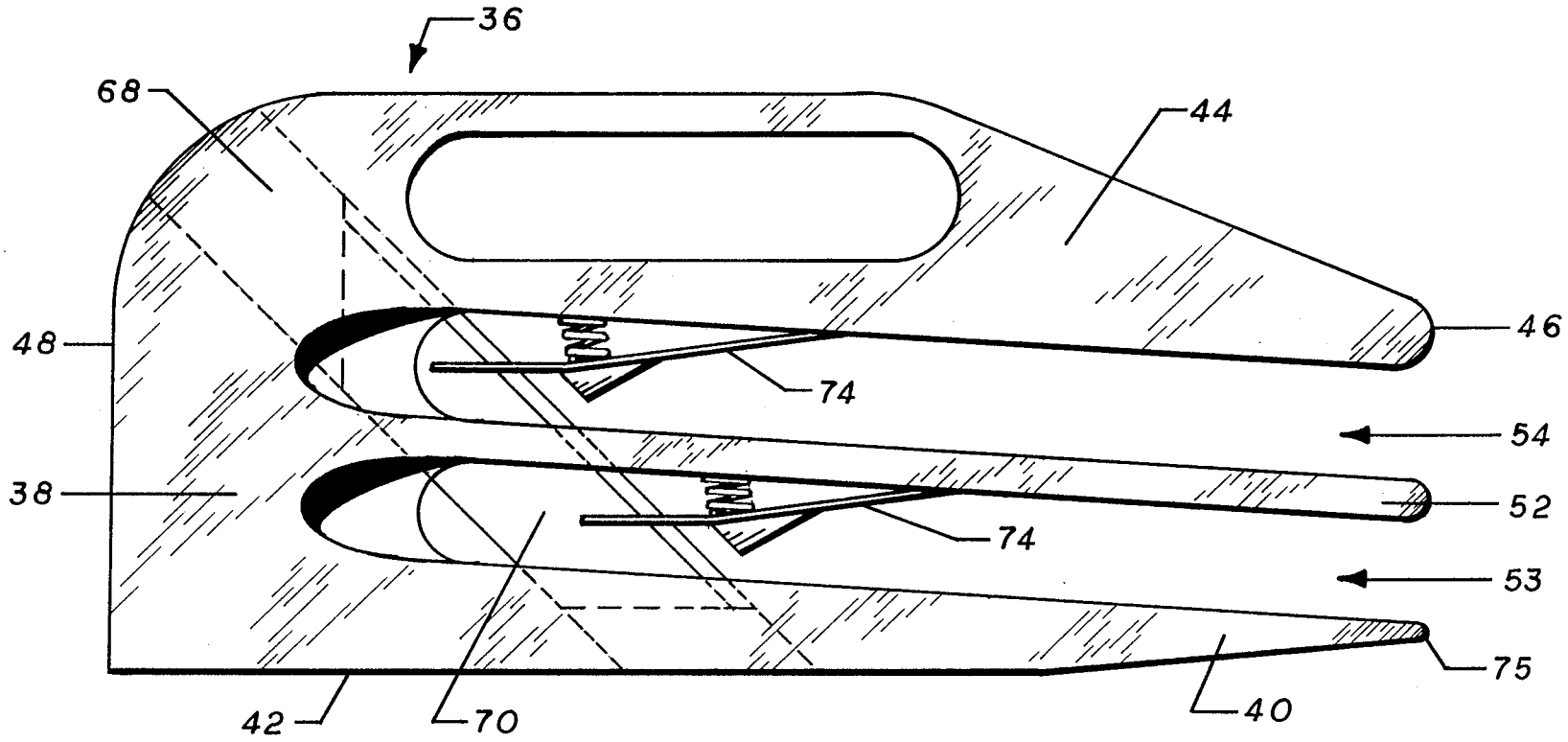

Referring to FIGS. 5, 6 and 7, a third preferred embodiment of the cutter herein (designated C'') according to the present invention is seen. The cutter C'' includes a body 78 similar to body 36, fingers 80, 82, 84 similar to fingers 40, 52, 44, respectfully, elongated planar surfaces 86, 88, 90, 92 similar to surfaces 56, 58, 62, 64, respectfully; a handle 94 similar to handle 50; a web portion 96 similar to web portion 38; slots 98, 100 similar to slots 53, 54; curved portions 101A, 101B similar to curved portions 60, 66, respectfully; and an undersurface 102 similar to undersurface 42, which is adapted to be drawn across the floor.

A circular blade 104 is rotatively disposed within body 78, with its axis of rotation disposed laterally to the axis of elongated slots 98, 100. A drive means is included for rotating the blade in a counter clockwise direction as indicated by arrows 106. As shown in FIG. 5, the drive means may include an electric motor 108, a planetary gear 110 which is rotatively attached to the side of body 78 and which is engaged with and rotated by motor 108 and a pinion gear 112 which extends axially from cutter 104 with its teeth meshed with the teeth of planetary gear 110, so that the rotation of planetary gear 110 due to the turning of motor 108 causes pinion gear 112 to rotate and transfer rotation to cutter 104 cause cutter 104 to rotate it in its counter-clockwise direction.

As best shown in FIGS. 6 and 7, pinion gear 112 and planetary gear 110 may be located on the exterior of body 78. Accordingly, a shaft 114 extends through body 78 and is fixedly attached to pinion gear 112 and circular cutter 104 along their mutual axis of rotation for transferring the rotation of pinion gear 112 to cutter wheel 104. Hence the circular cutter 104 provides the cutting means, and intersects with each horizontally extending longitudinal slot 98, 100 for severing the carpet backings as the undersurface 102, which functions as the base plate, is drawn across the floor.

In a similar manner as the previous embodiment, the lower planar surfaces 90, 96 are provided with an elongated spring-like member 116 similar to member 74 which are attached thereto and extend upward and rearward in slots 98, 100 to intersect with circular blade 104. In a similar manner, spring-like member 116 includes an unseen axial, bisecting slot at its tip 118 in which the circular cutting edge 119 is located so that the tip 118 of spring-like member 116 may move along a length of the curved periphery of blade 104 while moving laterally within slot 98, 100. Accordingly, adjacent the cutting edge 119 spring-like member 116 biases the carpet portions upward into engagement with planar surfaces 88, 92 at the point of cutting to aid in ease of cutting as the blade is rotated in its counter clockwise direction thus preventing the carpet from bunching, jamming and preventing vertical movement of the carpet portions as they are cut. As may further be appreciated, the cutter C'' is likewise symmetrical on both sides as the FIG. 2 embodiment and may be used similarly by right handed or left handed people.

As may be appreciated with the embodiments of FIG. 2 and FIG. 5, elongated spring-like members 74 or 116 bias the carpet portions into engagement with at least one of the guide means to aid in cutting and prevent bunching and vertical movement of the carpet portions as they are cut. Hence, this allows the cutter to be most useful for cutting carpets of varying thickness.

Further with the embodiment of FIG. 5, the blade rotates laterally through the carpet portions in the elongated slots to aid in providing a faster and smoother cut, as the carpet cutter C'' is drawn across the floor.

In use, a pair of unseen overlapping carpet portions which lie on a floor are positioned in the horizontally extending longitudinal slots 22, 24, 52, 54, or 98, 100 of the cutter C, C', or C'', respectfully, in which the lower carpet portion has a sliding engagement between surfaces 24, 26; 56, 58; or 86, 88 provided by plates 11, 18, fingers 40, 52, or fingers 52, 44 and the overlapping carpet portion has a sliding engagement between surfaces 28, 17, 62, 64, or 90, 92 provided by plates 18, 16, finger 52, 44; or finger 82, 84. With the carpet portions so positioned, the lower carpet portion may be slid between surfaces 24, 26; 56, 58; or 86, 88 in slot 20, 52 or 98, as the overlapping carpet portion is slid between surfaces 28, 17, 62, 64, or 90, 92 in slot 22, 54 or 100, all respectfully, simultaneously allowing alignment of the overlapped carpet portions to be maintained in a position suitable for making simultaneous, parallel abutting cuts in the carpet portions with blade 30, 70 or 104 to sever the carpet backings of the overlapping carpet portions. As may be appreciated, the simultaneous cutting of the two different sections of carpet along parallel lines allows the severed edges of the carpet sections to be abutted exactly to form an almost invisible seam.

With the embodiment of FIG. 5, as may be appreciated, lateral cutting of the carpet portions is also obtained as the undersurface 102 of the cutter C″ is drawn across the floor. Further, by providing spring-like members 74, 116 in the slots of the cutter, the overlapping carpet portions will be biased into contact with at least one of the guide means at the points of cutting, allowing the cutter to be most useful for cutting carpets of varying thickness.

Further, the cutters C, C′, or C″ may be useful as the carpet portions are simultaneously cut, in allowing simultaneous abutment of the severed edges of the carpet portions as the carpet portions are cut. This may be accomplished, for example, by providing a riser having a thickness essentially equal to the thickness of the carpet under the body of the lower carpet portion, near where the abutting cuts will be made. As the carpet portions are cut, the severed edges of the carpet portions may be vertically aligned to display the cut, after which the riser and trimmed lower carpet edge may be removed, allowing the carpet portions to lie flat. Alternatively, the trimmed edge of the lower carpet portion may be removed, as the carpet portions are being cut, allowing the severed edges to be vertically aligned to display the cut during cutting.

As may be appreciated, by maintaining parallel abutting cuts in the carpet sections, the novel cutters C, C′ or C″ herein may considerably reduce the time and expense heretofore involved in the laying of carpeting. Additionally the term "carpet" is intended to cover not only traditional forms of carpet or rug but also vinyl and other floor coverings, or indeed even wall coverings.

The embodiments described herein in detail for exemplary purposes thus are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A method of cutting a pair of overlapping, upper and lower carpet sections, having a lower carpet portion and an upper, overlapping carpet portion, to produce substantially identical, abutting edges between the carpet sections, comprising the steps of:

(a) providing a carpet cutter having a guide means above, below and between the upper and lower, overlapping carpet portions with the lower and intermediate guide means forming a slot into which the lower carpet portion is slid, and the upper and intermediate guide means forming a slot into which the upper, overlapping carpet portion is slid, said slots being vertically spaced, located one-above-the-other and positioning the upper and lower carpet portions in said slots; and (b) drawing the cutter with its guide means, in which the carpet portions are positioned, and its cutting blade along the carpet sections, simultaneously cutting the overlapping carpet portions with one-above-the-other, vertically spaced cuts, so that the severed edges of the carpet sections being immediately abuttable to form an almost invisible seam, with the severed part of the upper carpet portion falling unto the top, exposed side of the lower carpet portion, respectively.

2. The method of claim 1, wherein the step of drawing a blade to simultaneously cut the overlapping carpet portions includes the step of:

(c) simultaneously abutting the severed edges of the carpet portions as the carpet sections are being cut.

3. The method of claim 1, wherein the step of simultaneously cutting the carpet sections is achieved rotating said blade with motive powered means.

4. A carpet cutter for cutting a pair of overlapping carpet sections lying on for example a floor, the overlapping carpet sections having a lower carpet portion and an upper, overlapping carpet portion, comprising:

a body;

a flat, longitudinally and horizontally extending base plate having an undersurface thereon adapted to be drawn across a floor and extending downward from said body;

handle means included with said body for drawing said plate across the floor under the action of the user;

upper, intermediate and lower longitudinal guide means located on said body in a vertically spaced, parallel relationship between said undersurface and said body for forming a pair of spaced, parallel, upper and lower, one-above-the-other, horizontally extending, adjacent, longitudinal slots between said guide means, in which slots the overlapping carpet sections are respectively positioned in a configuration having the lower carpet portion positioned between said lower guide means and said intermediate guide means and the upper, overlapping carpet portion positioned between said intermediate guide means and said upper guide means, allowing the lower carpet portion to have a sliding engagement between said intermediate and lower guide means and the upper, overlapping carpet portion to have a sliding engagement between said intermediate and said upper guide means, maintaining alignment of the overlapped carpet portions suitable to make simultaneous, parallel, one-above-the-other, abutting cuts to sever the overlapping carpet portions, allowing the severed edges to be joined to provide an almost invisible seam; and cutting means attached to said body in a downward extending configuration adjacent said guides, said cutting means extending downward to intersect with each horizontally extending, longitudinal slot for severing the carpet backings as said base plate is drawn across the floor through the sections.

5. The carpet cutter of claim 4, wherein said cutting means is a pair of downward extending, diverging blades having cutting edges which face outwardly in opposite directions.

6. The carpet cutter of claim 4, wherein said handle means for drawing said plate across the floor includes a hump shaped handle extending upwardly from said body and positioned intermediate the ends of said base plate, and wherein said handle is attached to upwardly project from said body.

7. The carpet cutter of claim 4, wherein said cutting means is a downward extending blade which intersects diagonally with each horizontally extending longitudinal slot with its cutting edge facing into the longitudinal slots for severing the carpet backings as said base plate is drawn across the floor.

8. The carpet cutter of claim 4, wherein said body includes a downward extending web portion having a plurality of at least three, vertically spaced, longitudinally extended, elongated fingers which extend laterally from said web, said fingers constituting said guide means forming said slots.

9. The carpet cutter of claim 8, wherein said plurality of fingers is three in number.

10. The carpet cutter of claim 8, wherein said web portion and said fingers are cast in a single, integral structure, and wherein said cutting means comprises a single blade element extending down through both slots for cutting the carpet portions.

11. The carpet cutter of claim 8, wherein said web portion includes a curved portion between each of said fingers.

12. The carpet cutter of claim 11, wherein said curved portion tapers outward toward said web portion for allowing said web portion to easily pass between the cut carpet portions.

13. The carpet cutter of claim 8, wherein there is included an elongated spring-like portion in each one of said slots biasing the respective carpet section into contact with at least one of the guide means.

14. The carpet cutter of claim 4, wherein said cutting means is a powered, circular blade rotatively disposed within said body with its cutting edge intersecting said elongated slots and with its axis of rotation disposed laterally to the axes of said elongated slots.

15. The carpet cutter of claim 14, wherein said slots are separated by a vertical distance of less than about a half inch.

16. The carpet cutter of claim 4, wherein there is included an elongated spring-like portion in each of said slots biasing the respective carpet section into contact with at least one of the guide means.

17. A carpet cutter for cutting a pair of overlapping carpet sections lying on for example a floor, comprising:

a body having a downward extending web portion;

at least three vertically spaced, elongated fingers extending laterally from said web in a vertically spaced parallel relationship for providing upper, lower and intermediate, spaced, longitudinal guide means forming two elongated, one-above-the-other, adjacent slots therebetween, said fingers having an unattached free end for providing access to said slots;

cutting means attached to said body in a downward extending configuration adjacent said fingers, said cutting means extending downward to intersect with each elongated slot; and a curved portion included with said web between each of said fingers distal the free end of said fingers having said cutting means extending from said curved portion axially into said slots, said curved portion tapering from its juncture with said cutting means outward to its juncture with said web.

18. The carpet cutter of claim 17, wherein there is further included in each of said slots an elongated, spring-like member attached to a planar, elongated surface of one of the fingers forming the slot, which spring-like member extends rearward and distal said planar, elongated surface to intersect with said blade, said spring-like member including an axial, bisecting slot at its intersecting end in which axial slot the cutting edge of said blade is freely located.

19. The carpet cutter of claim 17, wherein said cutting means comprises:

a circular blade rotatively disposed in said body with its axis of rotation lateral to the longitudinal axes of said elongated slots, said blade having a curved cutting edge intersecting said slots for providing a cutting action lateral the axis of said slot.

20. The carpet cutter of claim 19, wherein there is further included in each of said slots:

an elongated, spring-like member attached to a planar, elongated surface of said finger which extends rearward and distal said planar, elongated surface to intersect with said blade, said spring-like member including an axial bisecting slot at its intersecting end in which the cutting edge of said blade is freely located.

* * * * *